US005743626A

United States Patent [19]

Walker

[11] Patent Number: 5,743,626

[45] Date of Patent: Apr. 28, 1998

[54] LIGHTING SYSTEM

[75] Inventor: Richard Walker, Urbana, Ohio

[73] Assignee: Grimes Aerospace Company, Urbana, Ohio

[21] Appl. No.: 790,002

[22] Filed: Jan. 28, 1997

Related U.S. Application Data

[63] Continuation of Ser. No. 388,239, Feb. 14, 1995, Pat. No. 5,636,919.

[51] Int. Cl.[6] ..... F21S 3/00

[52] U.S. Cl. ..... 362/217; 362/219; 362/251

[58] Field of Search ..... 362/217, 219, 362/221, 225, 251, 260

[56] References Cited

U.S. PATENT DOCUMENTS

| | | | |
|---|---|---|---|
| 2,487,467 | 11/1949 | Naysmith | 362/221 |
| 2,487,468 | 11/1949 | Naysmith | 362/221 |
| 2,489,686 | 11/1949 | Suter | 362/221 |
| 2,505,112 | 4/1950 | Hallman | 362/260 |
| 2,510,628 | 6/1950 | Goebel | 362/217 |
| 2,511,155 | 6/1950 | Gaynor | 362/217 |
| 2,522,044 | 9/1950 | Kelman | 362/217 |
| 2,530,017 | 11/1950 | Levenson | 362/260 |
| 2,567,726 | 9/1951 | Pistey | 362/217 |
| 2,569,662 | 10/1951 | Fallek | 362/217 |
| 2,574,019 | 11/1951 | Crockett, Jr. | 362/217 |
| 2,588,887 | 3/1952 | Semeyn | 362/217 |
| 2,765,397 | 10/1956 | Harris | 362/217 |
| 3,752,977 | 8/1973 | Davis | 240/51 |
| 3,851,295 | 11/1974 | Geier | 339/54 |
| 4,101,956 | 7/1978 | Crane | 362/217 |
| 4,109,303 | 8/1978 | Hetherington | 362/216 |
| 4,216,410 | 8/1980 | Feldstein | 315/86 |
| 4,338,653 | 7/1982 | Marrero | 362/223 |
| 4,580,200 | 4/1986 | Hess et al. | 362/223 |
| 4,795,357 | 1/1989 | Kosmol et al. | 439/232 |
| 5,145,392 | 9/1992 | Kemp | 439/232 |
| 5,207,504 | 5/1993 | Swift et al. | 362/217 |
| 5,432,690 | 7/1995 | Van Der Vliet et al. | 362/217 |
| 5,469,348 | 11/1995 | Wong | 362/217 |

FOREIGN PATENT DOCUMENTS

| | | | |
|---|---|---|---|
| 86 14 316 U | 11/1987 | Germany | F21S 3/02 |
| 3537601 C3 | 1/1991 | Germany | H01R 33/08 |

*Primary Examiner*—Ira S. Lazarus
*Assistant Examiner*—Alfred Basichas
*Attorney, Agent, or Firm*—Standley & Gilcrest

[57] ABSTRACT

The present invention is a unique lighting system. The lighting system includes a unique mount and mounting system, a unique lampholder and a unique power conditioning circuit arrangement.

1 Claim, 13 Drawing Sheets

LIGHTING SYSTEM

This application is a continuation of Ser. No. 08/388,239, filed Feb. 14, 1995, now U.S. Pat. No. 5,636,919.

BACKGROUND AND SUMMARY OF THE INVENTION

The present invention relates generally to the art of lighting and more particularly to an arrangement for lighting the cabin of an aircraft.

Prior fluorescent lamps have been introduced into their holders through the insertion of their lateral or end contact pins into a guiding slot, and are then placed into their operative position through the application of pressure with a concurrent rotation of the lamp. This "turning-in" sequence cannot be implemented in a particularly comfortable manner, and especially in the utilization of such fluorescent lamps in the passenger cabins of airplanes subject to extremely narrow or restrictive space conditions, the insertion of such fluorescent lamps necessitates the expenditure of considerable amounts of effort.

Additionally, it is also known to secure the fluorescent lamps in their holders through the employment of a latching lever, particularly during their use in airplanes. However, these mechanisms have required large volumes of space in which to operate; space which comes at a premium on an airplane.

One aspect of the present invention is directed to alleviating this problem by providing a compact self-locking mechanism to mount lamps within their respective holders while maintaining positive electrical contact. The present invention employs a unique lampholder. The lampholder of the present invention may utilize a pair of retaining springs, a pair of biasing springs and a plunger. The retaining springs of the present invention serve to lock the lamp pins in position. The biasing springs serve to oppose the retaining springs and also serve to position the lamp pins. Preferably, the springs serve as conductors in addition to their structural purpose. The plunger serves to separate the retaining springs to release the lamp pins from contact with the springs. The lampholder may also have a separate set of flexible tabs to prevent the lamp pins from exiting the lampholder prematurely or unintentionally. By utilizing the lampholder of the present invention, a positive electrical contact is maintained with the lamp even though it may be subjected to substantial vibration. The present invention accomplishes this purpose while providing an easy means of installing and removing lamps within the lampholder.

Another aspect of the present invention is directed to solving the problems associated with fixture maintenance and weight considerations. Previous light systems have utilized a dedicated power supply for each light fixture. Additionally, removal and installation of light fixtures has required the use of tools. This slows maintenance and therefore increases the costs associated with maintenance of such a lighting system. The present invention provides an easy, tool free method for removing and replacing light fixtures. The present invention may utilize a unique fixture that may be in previously known mounts but may also utilize a unique combination of fixture mounts and fixtures. The present invention allows a lighting system to benefit from a division or sharing of circuit elements across more than one fixture to minimize the weight associated with such lighting systems.

The lighting system includes a power source, two pairs of lampholders, and an electrical circuit. The electrical circuit is in electrical communication with the first pair of lampholders and the power source. The second pair of lampholders is in electrical communication with the first pair of lampholders. The power source provides power to both pairs of lampholders. The electric circuit has some elements which control both pairs of lampholders, and other elements which control only the first pair of lampholders. There may also be a second electric circuit in electrical communication with the second pair of lampholders which has elements which control only the second pair of lampholders.

Other principal features and advantages of the invention will become apparent to those skilled in the art upon review of the following detailed description, claims and drawings.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION OF PREFERRED EMBODIMENTS

Figure 1:
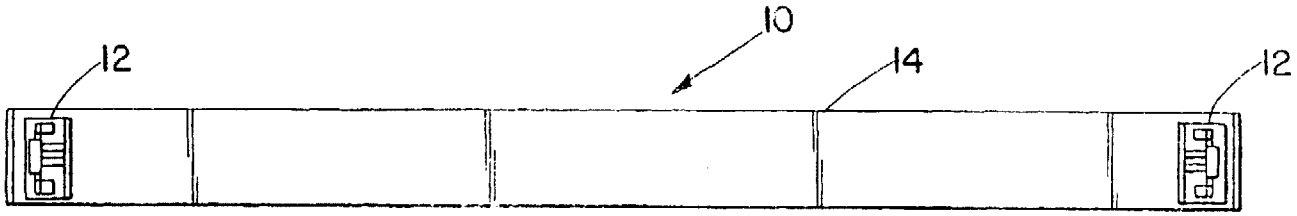
FIG. 1 is a top plan view of a preferred embodiment of the present invention.
Figure 2:
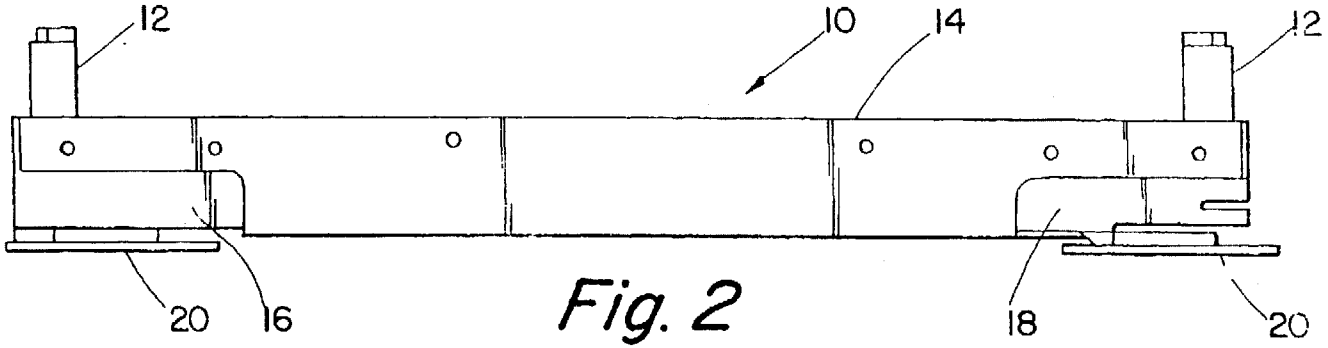
FIG. 2 is a front elevation view of the embodiment of FIG. 1.
Figure 4:
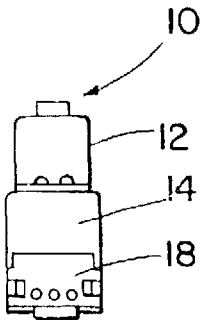
FIG. 4 is a right side view of the embodiment of FIG. 1.
Figure 3:
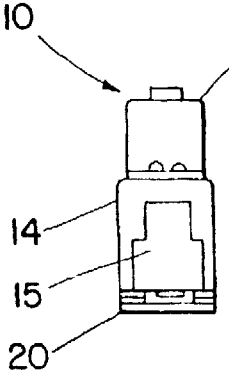
FIG. 3 is a left side view of the embodiment of FIG. 1.

Referring to FIGS. 1–4, a preferred embodiment of the cabin lighting system of the present invention is shown at 10. Lampholder assembly 12 is attached to a housing 14 that may extend for any desired length. Housing 14 is attached to both an output end 16 and an input end 18 which in turn are each attached to a mounting 20. FIG. 4 is shown without mounting 20. Each mounting 20 is attached to a location within the structure that the lighting system is intended to illuminate. A lamp (not shown) may be fitted between lampholders 12.

Figure 5:
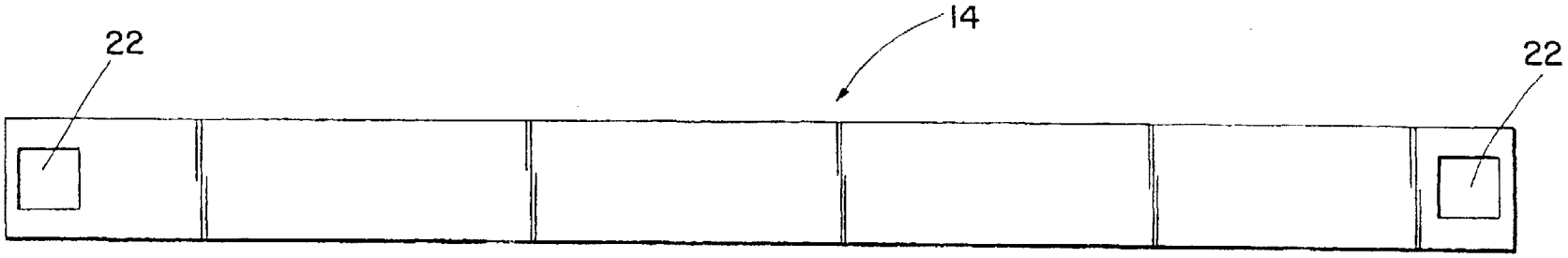
FIG. 5 is a top plan view of a housing of the present invention.
Figure 6:
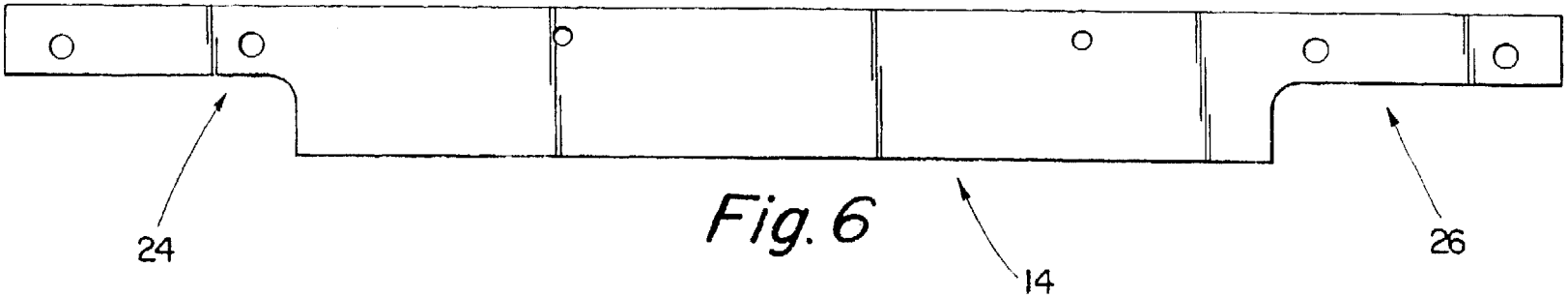
FIG. 6 is a front elevation view of the housing of FIG. 5.
Figure 7:
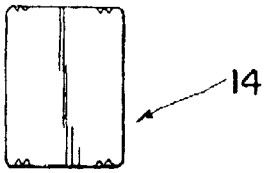
FIG. 7 is a side view of the housing of FIG. 5.

Referring now to FIGS. 5–7 the housing 14 may be seen in more detail. Housing 14 may have openings 22 at each end that are configured to receive lampholders 12. Additionally, housing 14 may be configured to receive an output end 16 at 24 and an input end 18 at 26.

Figure 9:
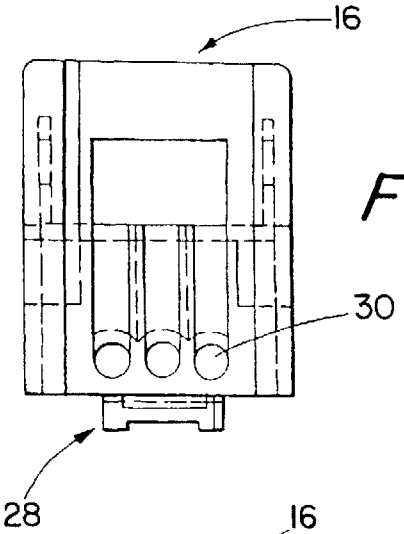
FIG. 9 is a right side view of the output end of FIG. 8.
Figure 8:
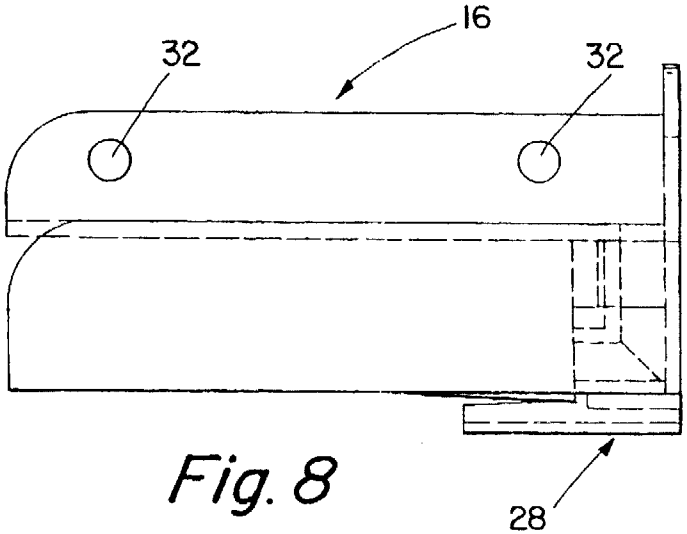
FIG. 8 is an elevation view of an output end of the present invention.

FIGS. 8 and 9 show an output end 16 of the present invention. Output end 16 may be configured to connect to a mounting 20 at 28. Output end 16 may also be configured to allow wiring to pass through at 30 to an associated input end 18. Lastly, output end 16 may also be configured to attach to housing 14 at 32.

Figure 11:
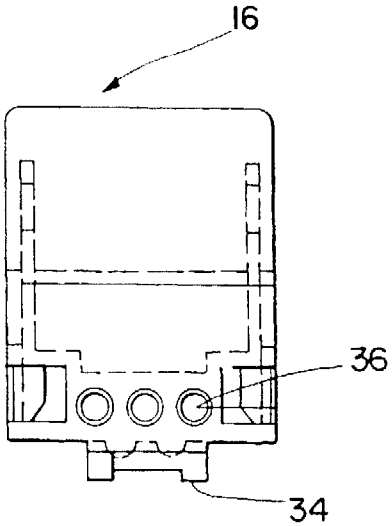
FIG. 11 is a right side view of the input end of FIG. 8.
Figure 10:
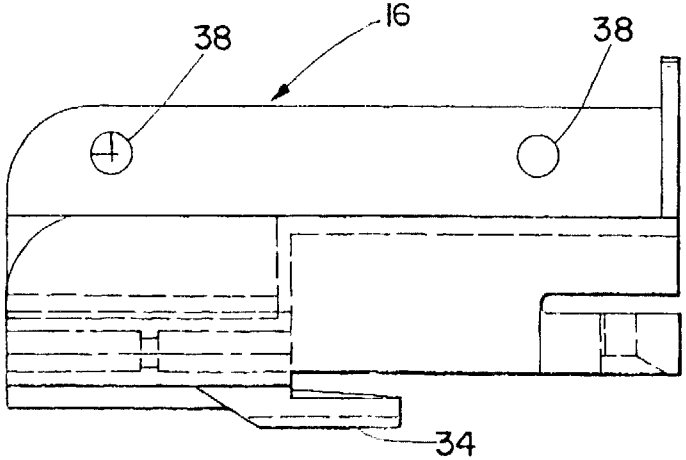
FIG. 10 is an elevation view of an input end of the present invention.

FIGS. 10 and 11 show an input end 18 of the present invention. Input end 18 may be configured to connect to a mounting 20 at 34. Input end 18 may be configured to receive electrical power via electrical wiring or connections at 36 from an associated output end 16 or an external power supply. Lastly, input end 16 may be configured to attach to housing 14 at 38.

Figure 12:
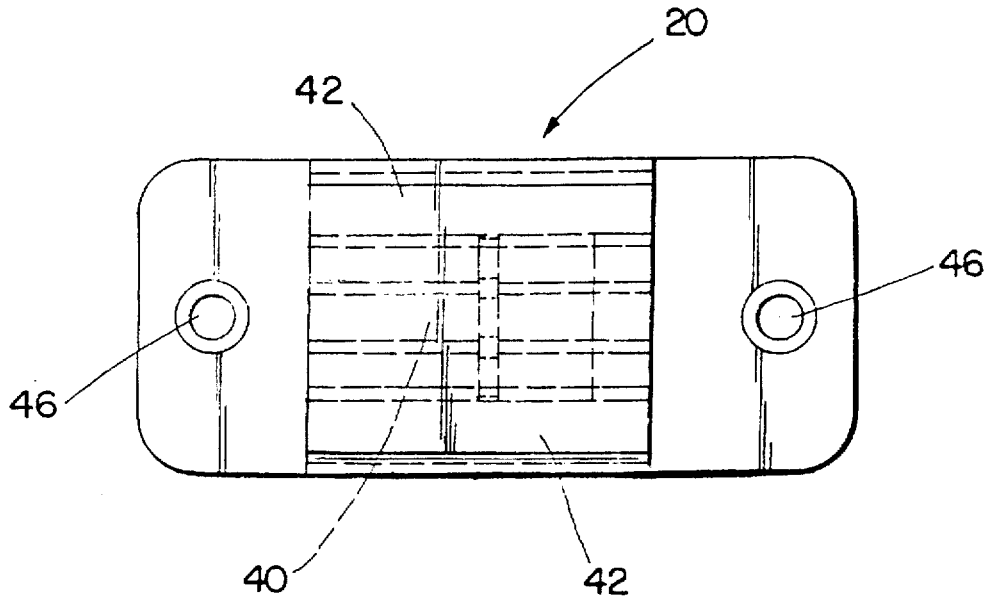
FIG. 12 is a plan view of a mounting of the present invention.
Figure 13:
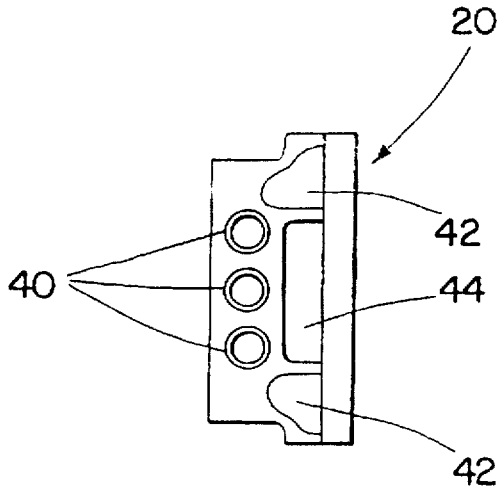
FIG. 13 is a right side view of the mounting of FIG. 12.

FIGS. 12 and 13 show a mounting 20 of the present invention. Mounting 20 may be configured to receive wire connectors generally at 40 to establish connections between either a power supply external to the lighting system and a primary fixture or a primary fixture and a secondary fixture. Mounting 20 may also have a channel to allow wiring to pass at 42. Mounting 20 may also have a lower chamber 44 to receive a tab from either an input end 18 or an output end 16. Lastly, mounting 20 may be configured to attach to a structure with a fastener plate 40.

Figure 14:
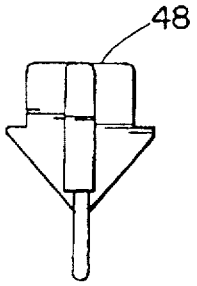
FIG. 14 is an elevation view of a plunger of the present invention.
Figure 15:
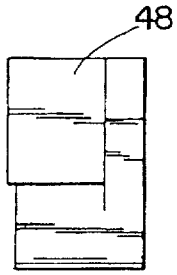
FIG. 15 is a right side view of the plunger of FIG. 14.
Figure 16:
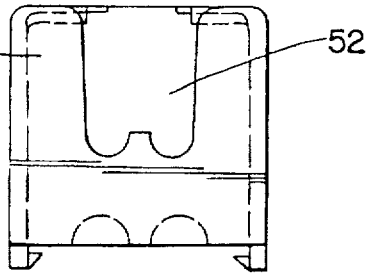
FIG. 16 is an elevation view of a housing of the present invention.
Figure 17:
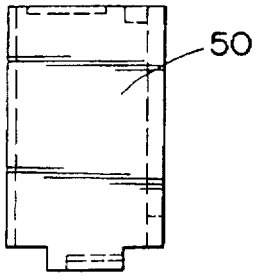
FIG. 17 is a right side view of the housing of FIG. 16.
Figure 18:
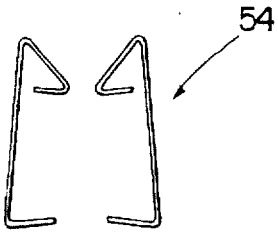
FIG. 18 is an elevation view of retaining contacts of the present invention.
Figure 19:
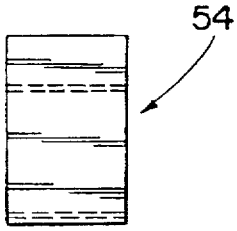
FIG. 19 is a right side view of the contacts of FIG. 18.
Figure 20:
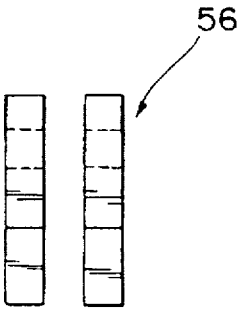
FIG. 20 is an elevation view of biasing contacts of the present invention.
Figure 21:
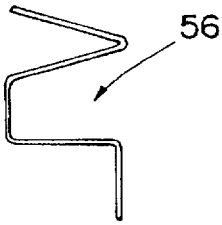
FIG. 21 is a right side view of the contacts of FIG. 20.
Figure 22:
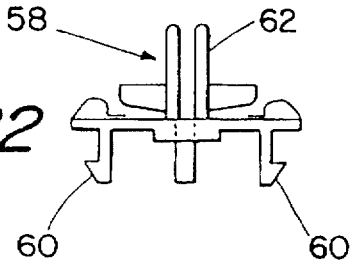
FIG. 22 is an elevation view of a base of the present invention.
Figure 23:
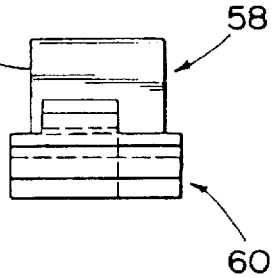
FIG. 23 is a right side view of the base of FIG. 22.
Figure 24:
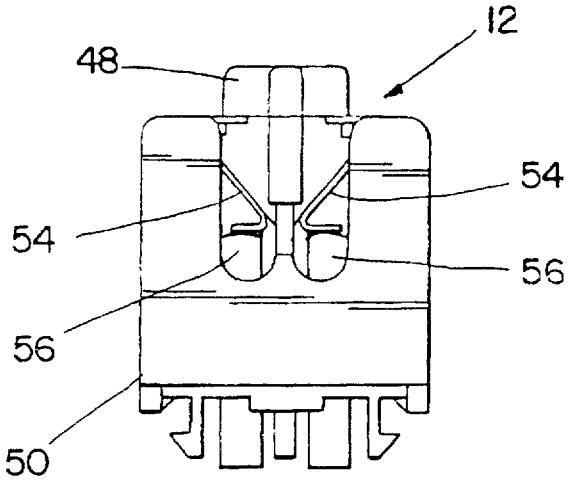
FIG. 24 is a front elevation view of a lampholder assembly of the present invention.
Figure 25:
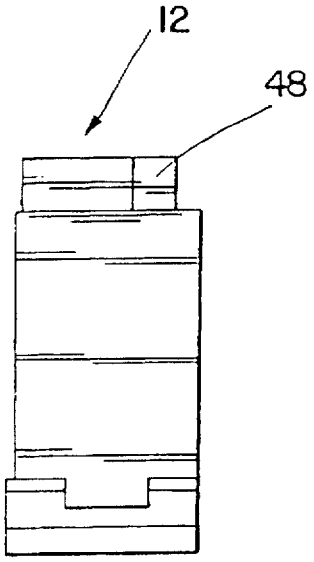
FIG. 25 is a right side view of the lampholder assembly of FIG. 24.
Figure 26:
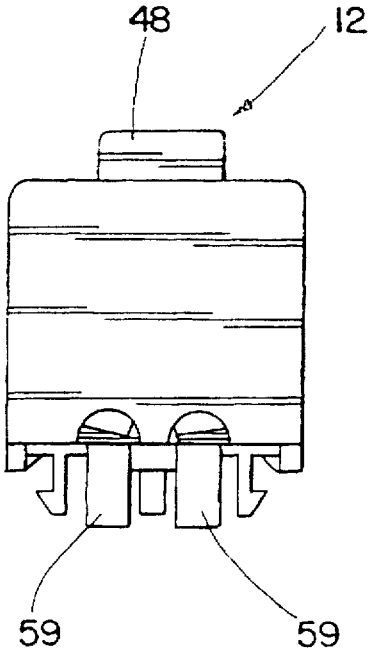
FIG. 26 is a rear elevation view of the lampholder assembly of FIG. 24.
Figure 27:
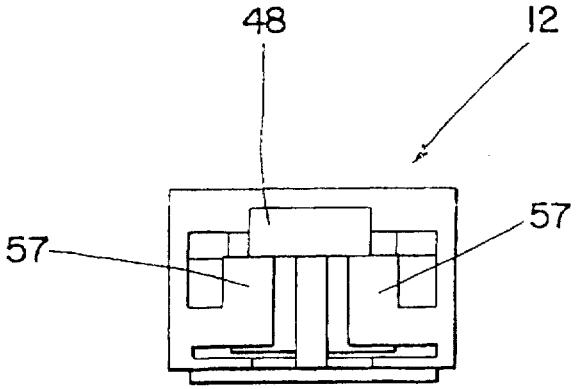
FIG. 27 is a top plan view of the lampholder assembly of FIG. 24.

Referring now to FIGS. 14–27 components of a lampholder assembly 12 are shown in FIGS. 14–23 and the lampholder assembly is shown in FIGS. 24–27. The operation of the lampholder assembly will be explained below. A plunger 48 is shown in FIGS. 14 and 15. A housing 50 is shown in FIGS. 16 and 17. Housing 50 is configured to receive lamp pins at 52. Retaining springs 54 are shown in FIGS. 18 and 19. Biasing springs 56 are shown in FIGS. 20 and 21. A base 58 is shown in FIGS. 22 and 23. Base 58 may be configured to attach to housing 14 at 60. Base 58 may also be configured at 62 to receive and guide plunger 48.

The assembled lampholder 12 is shown in FIGS. 24–27 and 38. Lampholder assembly 12 preferably is designed to accommodate a two pin lamp (shown in outline in FIG. 38). The operation of the lampholder assembly 12 may perhaps best be understood in reference to FIGS. 24, 27, and 38. Plunger 48 may be depressed to force retaining springs 54 apart. A lamp's pins may then pass into the opening of the housing 50 past flexible tabs 57 and retaining springs 54 until the pins reside on the biasing springs 56. The plunger 48 may then be released to allow the retaining springs 54 to maintain the lamp pins position within the housing 50 and to allow the biasing springs 56 to bias the lamp pins against the retaining springs 54. The biasing springs 56 serve to maintain electrical contact between the springs 54 and 56 and the lamp pins. The retaining springs 54 serve to retain the lamp within the housing and to provide electrical contact with the lamp pins. To release the lamp from the lamp holder assembly 12 one may depress the plunger 48 to again allow the retaining springs 54 to separate and to force the biasing springs 56 down. The lamp pins are then released from contact with the springs 54 and 56 and may then pass out of the housing 50 after passing flexible tabs 57. Biasing springs 56 extend out of the housing and may be connected to a power supply at 59.

Figure 28B:
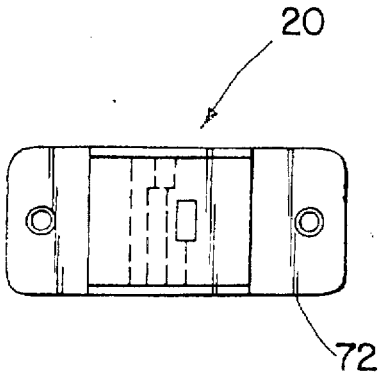
FIGS. 28A, 28B, and 28C is a plan view of an example layout of mountings of the present invention.
Figure 28A:
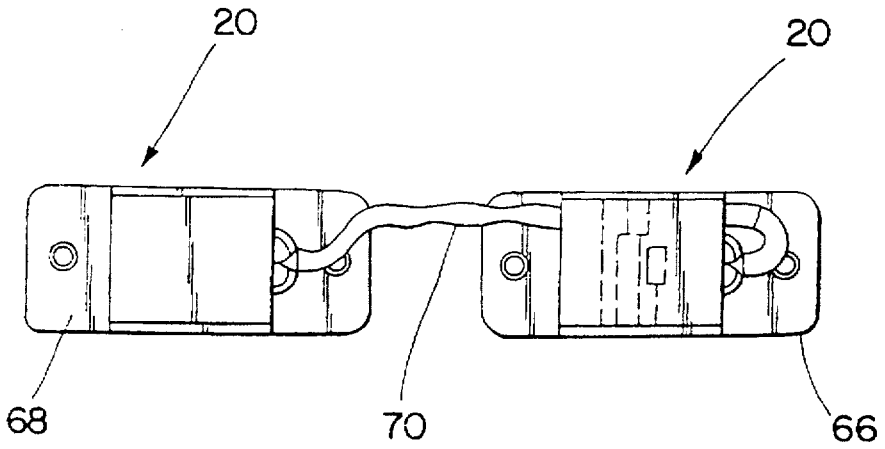
Figure 28C:
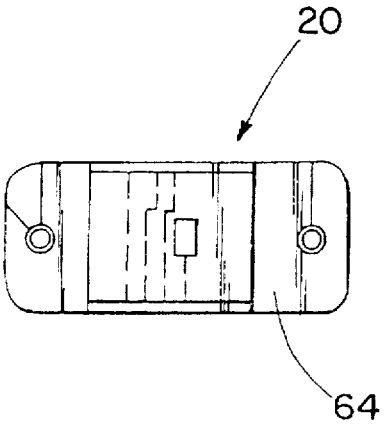

FIG. 28 shows a preferred layout of mountings 20 of the present invention. An important aspect of the present invention is the reduction in weight over prior lighting systems. The present invention may utilize a first circuit that is connected to a power source that in turn provides conditioned power to a second circuit. The first circuit may be located in a primary fixture and the second circuit may be located in a secondary fixture. Prior systems utilized duplicative electric circuit elements. The present invention removes duplicative circuit elements and thereby saves weight. This is especially important in aircraft where fuel savings may be realized.

The present invention utilizes a system of mountings 20 that each have a set of integral contacts. Referring to FIG. 28, a first mounting 64 may receive power from a source external to the lighting system (not shown). First mounting 64 may then be connected to a primary fixture that receives the power passing through the first mounting 64. The primary fixture may then provide light and condition the power for transmission to a secondary fixture. Primary fixture may be connected to a second mounting 66. Second mounting 66 may then be in electrical communication with a third mounting 68 through wiring 70. A secondary fixture may then be connected to the contacts of the third mounting 68. A fourth mounting 72 may be provided to mount the secondary fixture to the structure external to the lighting system.

Figure 29A:
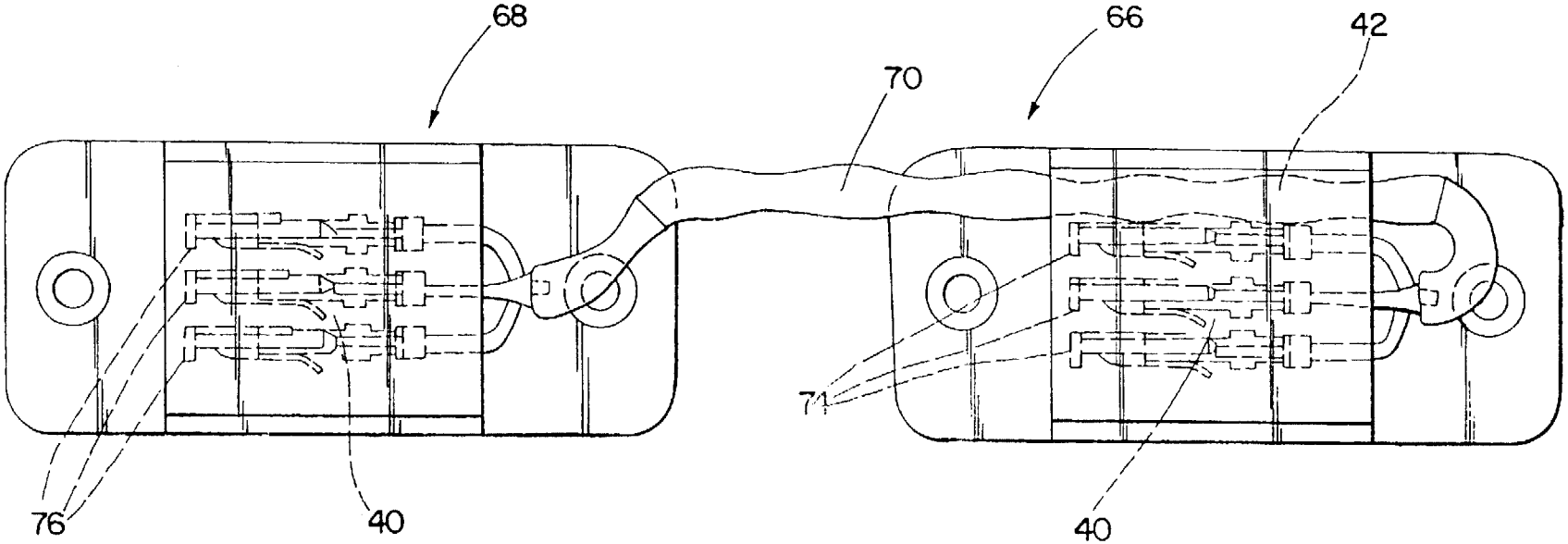
FIGS. 29A and 29B is a plan view of the connections between two mountings of the present invention.
Figure 29B:
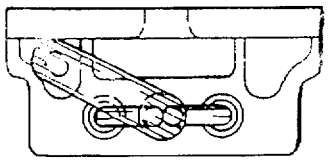

FIG. 29 shows a more detailed view of the electrical communication that may be established between a second mounting 66 and a third mounting 68 by wiring 70. Electrical connections may be established at 74 between a primary fixture and the second mounting 66. These connections may pass through second mounting 66 via a contact system 40. Wiring 70 may extend from the contact system 40 and pass through a channel 42 to connect with third mounting 68 at another contact system. A secondary fixture may be electrically connected to the third mounting 68 at 76 to receive conditioned electrical power.

Figure 30:
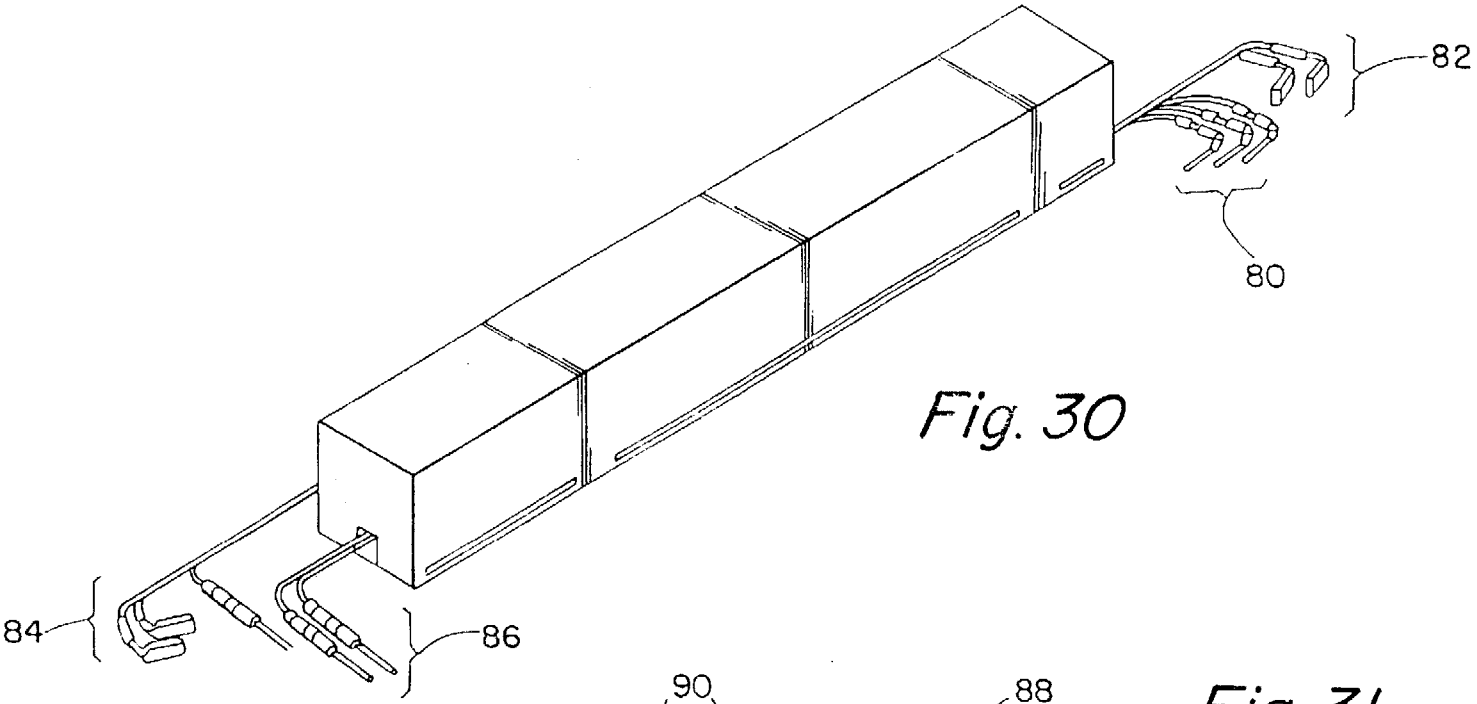
FIG. 30 is a perspective view of a power supply circuit card assembly of the present invention.

FIG. 30 shows a first circuit assembly for a primary fixture at 78. A set of three leads 80 extend from the first circuit assembly 78 that may connect to a first mounting 64 to receive power from a source external to the lighting system. Two leads 82 may extend from the first circuit assembly 78 to attach to biasing springs 56 to provide power at one end of a lamp through a lampholder assembly 12. Two leads 84 may extend from the first circuit assembly 78 to attach to biasing springs 56 to provide power at another end of a lamp through another lampholder assembly 12. Three leads 86 may extend from the first circuit assembly 78 to attach to a second mounting 66 to provide conditioned power to a secondary fixture. First circuit assembly may be located within a housing 14 of a primary fixture.

Figure 31:
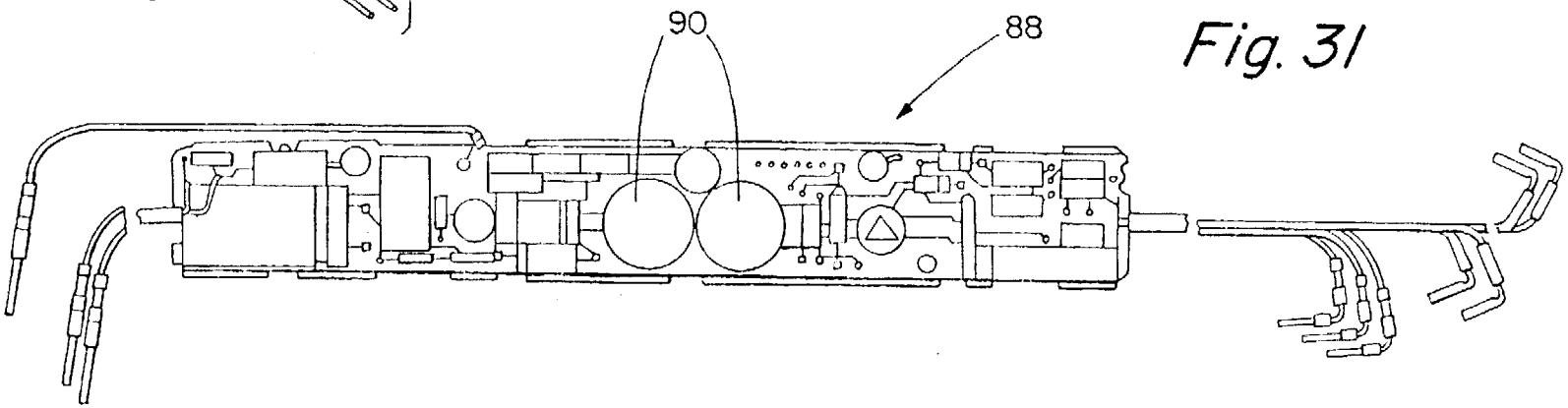
FIG. 31 is a plan view of a circuit card of the power supply of FIG. 30.
Figure 32:
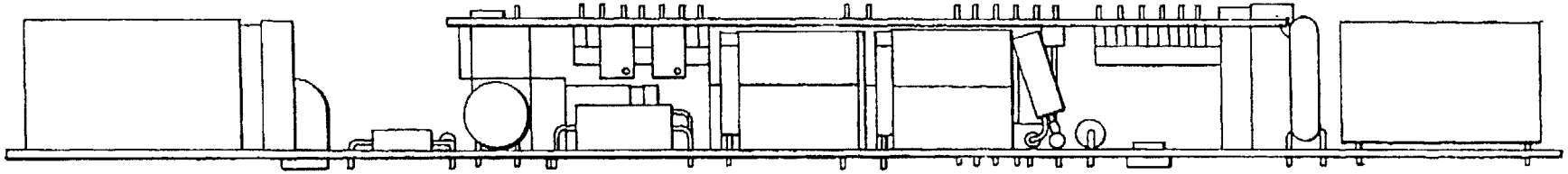
FIG. 32 is an elevation view of the circuit card assembly of FIG. 30 without the EMI housing.
Figure 33:
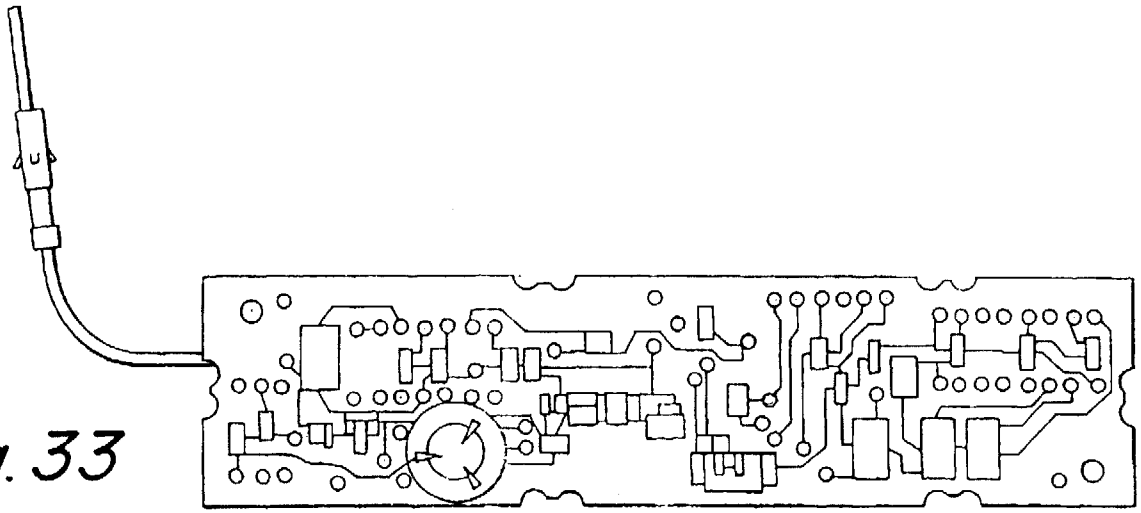
FIG. 33 is a plan view of another circuit card of the power supply of FIG. 30.

Referring to FIGS. 31–33, the circuit cards internal to the first circuit assembly 78 may be seen. A first circuit card 88 may provide an EMI filter, a rectifier, a power control circuit, a dim control circuit, a soft start circuit, and a pulse width modulator which may be utilized to control both primary and secondary fixtures. First circuit card 88 may also provide a resident capacitor, a set of filament voltage dividers, and a thermistor to further condition the power for the primary fixture only.

Figure 34:
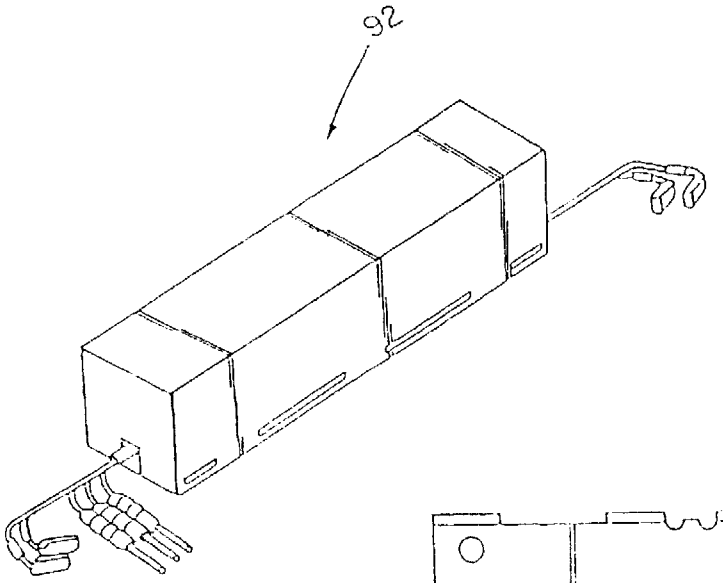
FIG. 34 is a perspective view of another power supply circuit card assembly of the present invention.
Figure 35:
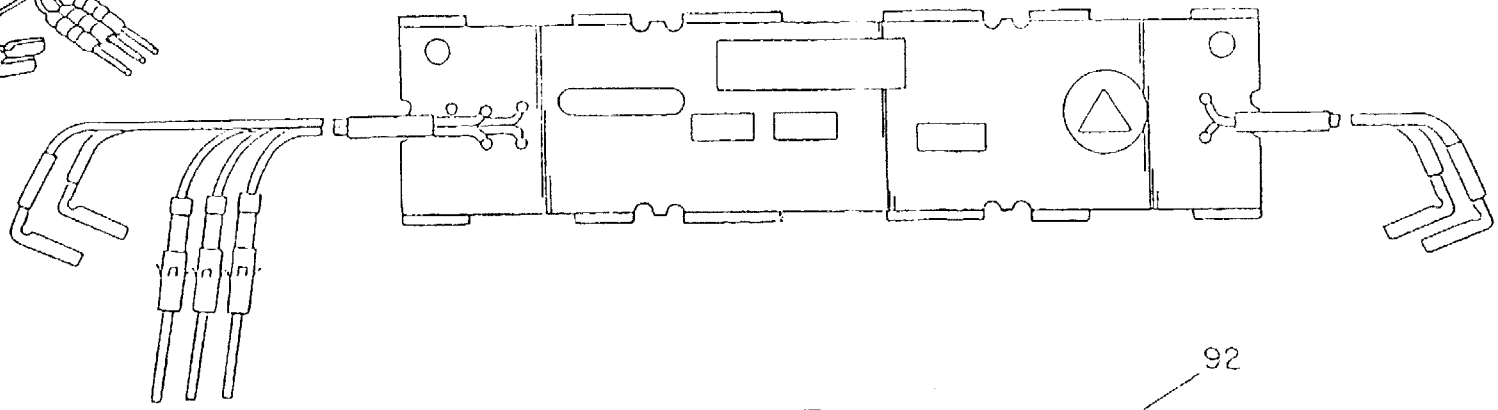
FIG. 35 is a plan view of a circuit card of the power supply of FIG. 33.
Figure 36:
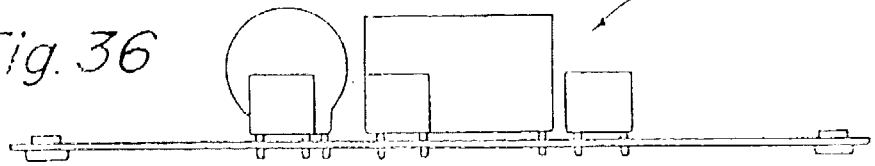
FIG. 36 is an elevation view of the circuit card of FIG. 34.

Referring now to FIGS. 34–36, a second circuit 92 which may reside within a secondary fixture may be seen. Second circuit 92 may be configured to receive conditioned power from a first circuit card 88 and to further condition that power to apply it to a secondary fixture lamp. Second circuit 92 may provide a resident capacitor, a set of filament voltage dividers, and a thermistor.

Figure 37:
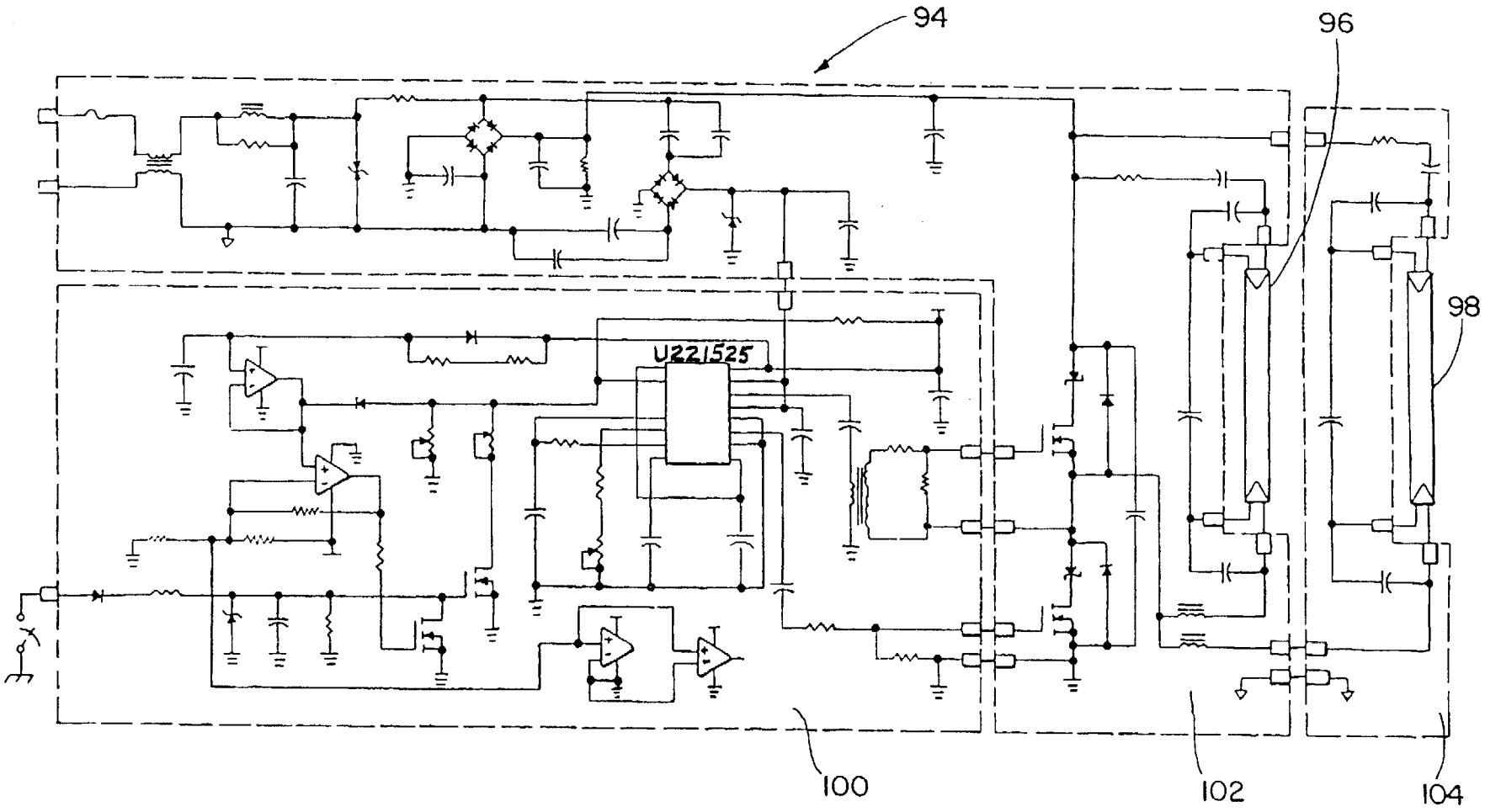
FIG. 37 is a schematic of a circuit of the present invention.
Figure 38:
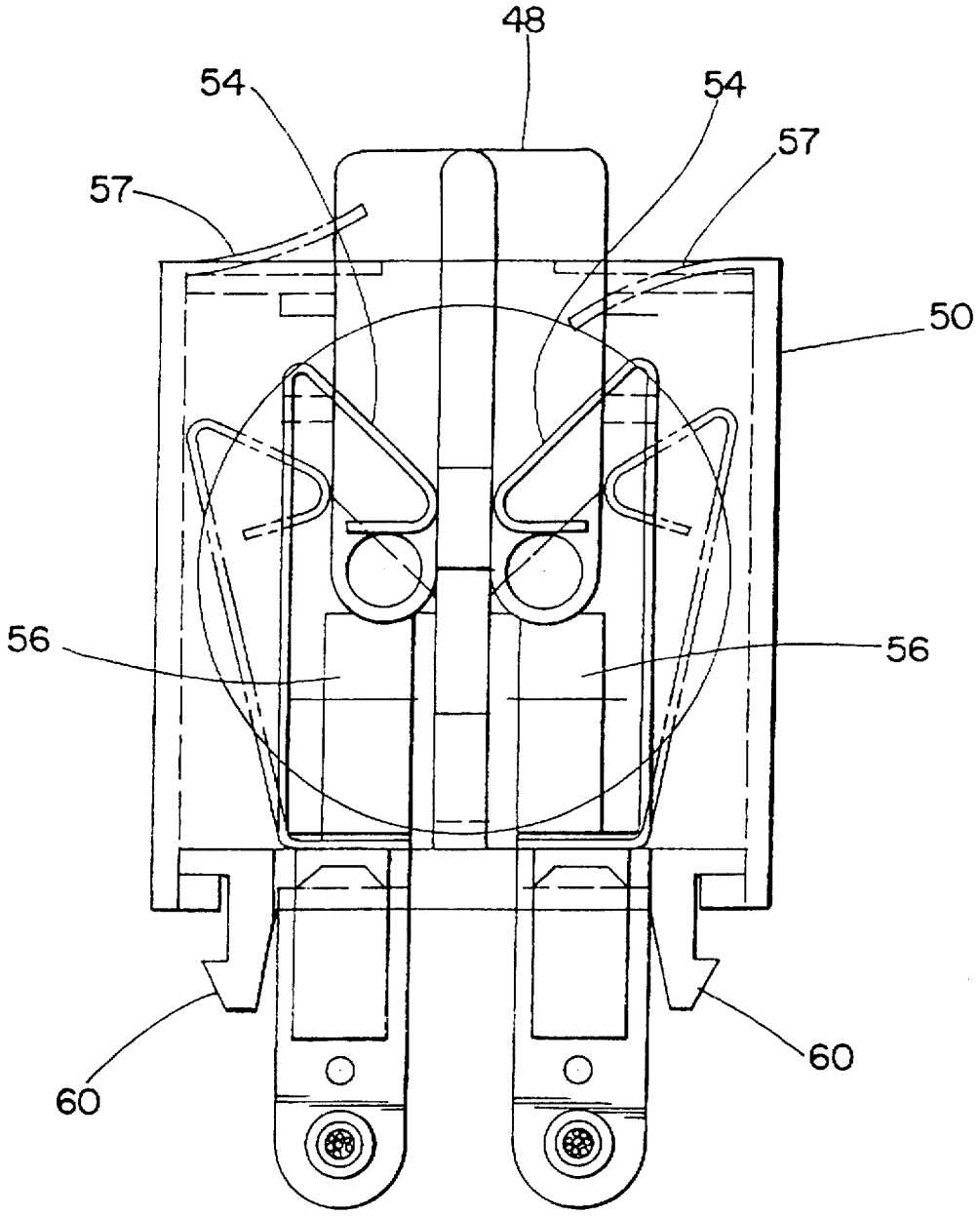
FIG. 38 is a cross-section of the lampholder assembly.

Referring, now to FIG. 37, a complete schematic of the electrical configuration of the present invention may be seen at 94. A primary fixture lamp 96 and a secondary fixture lamp 98 is shown connected to the remaining portions of the circuit. The first circuit 88 of the present invention encompasses all circuit elements within areas 100 and 102 as defined by dashed lines. Secondary circuit 92 encompasses all circuit elements within area 104 as defined by dashed line. The scope of the invention is not to be considered limited by the above disclosure, and modifications are possible without departing from the spirit of the invention as evidenced by the following claims.

What is claimed is:

1. A compact, self-locking lampholder for a fluorescent lamp having two lamp pins, comprising:

a housing;

an opening in the housing for receiving the lamp pins;

a pair of retaining springs mounted in the housing and configured to retain the lamp pins within the housing;

a pair of biasing springs adjacent one another and positioned relative to the retaining springs; and a plunger, mounted in the housing, the plunger when depressed moves the retaining springs apart and compresses the biasing springs so that the lamp pins may be placed in the opening of the housing, and when the plunger is released, the lamp pins are locked in place, the biasing springs biasing the lamp pins against the retaining springs.

* * * * *

UNITED STATES PATENT AND TRADEMARK OFFICE

CERTIFICATE OF CORRECTION

PATENT NO. : 5,743,626

DATED : April 28, 1998

INVENTOR(S) : Richard Walker

It is certified that error appears in the above-indentified patent and that said Letters Patent is hereby corrected as shown below:

In colum 3, line 64, please delete the number "40" and replace it with -- 46 --.

Signed and Sealed this

Seventh Day of July, 1998

Bruce Lehman

*Attest:*

BRUCE LEHMAN

*Attesting Officer*

*Commissioner of Patents and Trademarks*